US009421445B2

(12) United States Patent
Heiling et al.

(10) Patent No.: US 9,421,445 B2
(45) Date of Patent: Aug. 23, 2016

(54) METHOD AND DEVICE FOR THROW TRAINING

(71) Applicants: Attila Heiling, Luxembourg (LU); Carsten Steiner, Diekirch (LU)

(72) Inventors: Attila Heiling, Luxembourg (LU); Carsten Steiner, Diekirch (LU)

( * ) Notice: Subject to any disclaimer, the term of this patent is extended or adjusted under 35 U.S.C. 154(b) by 0 days.

(21) Appl. No.: 14/347,121

(22) PCT Filed: Sep. 26, 2012

(86) PCT No.: PCT/EP2012/068995
§ 371 (c)(1),
(2) Date: Mar. 25, 2014

(87) PCT Pub. No.: WO2013/045511
PCT Pub. Date: Apr. 4, 2013

(65) Prior Publication Data

US 2014/0287853 A1 Sep. 25, 2014

(30) Foreign Application Priority Data

Sep. 27, 2011 (LU) ..... 91878

(51) Int. Cl.
*A63B 69/00* (2006.01)
*A63B 71/02* (2006.01)

(52) U.S. Cl.
CPC ..... *A63B 69/0071* (2013.01); *A63B 2071/025* (2013.01); *A63B 2071/026* (2013.01); *A63B 2225/09* (2013.01); *A63B 2225/093* (2013.01); *A63B 2243/0037* (2013.01)

(58) Field of Classification Search
CPC ..... A63B 63/083; A63B 69/0071
USPC ..... 473/477, 472, 476, 483, 447, 422, 197, 473/446, 438, 433, 479, 481; 135/90
See application file for complete search history.

(56) References Cited

U.S. PATENT DOCUMENTS

| | | | | |
|---|---|---|---|---|
| 3,427,025 | A * | 2/1969 | Procter | 473/483 |
| 3,675,921 | A | 7/1972 | Meyers, Sr. | |
| 4,183,524 | A * | 1/1980 | Kifferstein et al. | 473/435 |
| 4,538,808 | A | 9/1985 | Holland | |
| 5,485,993 | A | 1/1996 | Lipsett | |

(Continued)

FOREIGN PATENT DOCUMENTS

| | | | |
|---|---|---|---|
| CN | 2920331 | Y | 7/2007 |
| FR | 2708474 | A1 | 2/1995 |

(Continued)

*Primary Examiner* — Gene Kim
*Assistant Examiner* — Rayshun Peng
(74) *Attorney, Agent, or Firm* — Nath, Goldberg & Meyer; Jerald L. Meyer; Stanley N. Protigal

(57) ABSTRACT

A device (1) for ball-throwing training has a base (4) and at least two vertical guide posts (30, 31) longitudinally adjusted relative to each other. One end of one of the guide posts (30) is positioned at the base (4) and a distal end of another guide post (31) is positioned at the spacer element (35). A covering surface (2) is fixed to the spacer element (35) so as to at least partially obscure the view of a throwing target, and has an extendible screen (20) and a stretch frame (23). The spacer element (35) is arranged, on the side of the guide post (31) that lies opposite the stand base, in such a manner that the covering surface (2) normally is arranged at right angles to the spacer element (35). In that position, the ground projection areas of covering surface (2) and stand base (4) do not overlap.

13 Claims, 3 Drawing Sheets

(56) References Cited

U.S. PATENT DOCUMENTS

| | | | | |
|---|---|---|---|---|
| 5,527,185 | A | 6/1996 | Davis | |
| 5,632,480 | A * | 5/1997 | Davis et al. | 473/483 |
| 5,816,951 | A | 10/1998 | Hudock | |
| 6,155,938 | A * | 12/2000 | Mower | 473/484 |
| 7,175,549 | B2 * | 2/2007 | LeFlore | 473/448 |
| 2004/0157685 | A1 | 8/2004 | Hodges | |
| 2006/0105863 | A1 | 5/2006 | LeFlore | |
| 2007/0010354 | A1 * | 1/2007 | White | 473/447 |
| 2009/0149281 | A1 | 6/2009 | Johnson | |
| 2010/0160093 | A1 | 6/2010 | Macarthur | |
| 2010/0267496 | A1 * | 10/2010 | Johnson | 473/447 |

FOREIGN PATENT DOCUMENTS

| | | | | |
|---|---|---|---|---|
| WO | 2004056427 | A1 | 7/2004 | |
| WO | WO 2004056427 | A1 * | 7/2004 | A63B 69/00 |

* cited by examiner

METHOD AND DEVICE FOR THROW TRAINING

This is a National Phase application filed under 35 U.S.C. 371 as a national stage of PCT/EP2012/068995, filed Sep. 26, 2012, and claims priority benefit from Luxembourg Application No. 91878, filed Sep. 27, 2011, the content of each of which is hereby incorporated by reference in its entirety.

TECHNICAL FIELD

The present invention relates generally to a method and an apparatus for throw training, e.g. in basketball.

PRIOR ART

There are numerous apparatuses and aids designed to improve the throwing accuracy during the game of basketball.

A first group concerns aids that are intended to give the beginner an understanding of the "ideal" pattern of movement when throwing the ball. These aids are principally based either on promoting the correct pattern of movement or on preventing an incorrect approach. Through repetition, the player will eventually perform the correct movement automatically without assistance. In general, however, these aids are only suitable for throwing from a standing position.

A second group concerns obstacles that are placed on the court in order to force the player to run round them and then to throw, or to jump and throw the ball over them.

In this group, there are, on the one hand, static obstacles which in principle simulate an opponent or at least a part of this opponent to a more or less realistic extent. This subgroup also comprises obstacles with partially adjustable parts. Such solutions are known, for example, from FR 2 708 474, U.S. Pat. No. 5,485,993A, U.S. Pat. No. 5,527,185A, U.S. Pat. No. 5,816,951A and US 2009/149281A.

A further subgroup concerns similar obstacles which, however, have parts that are moved during training, e.g. movable arms, etc. The purpose of these moved parts is to more realistically represent an opponent and thus make the throw even more difficult for the player. Some examples are to be found in the following documents: U.S. Pat. No. 3,675,921A and CN 2 920 331Y.

Finally, this second group also comprises more abstract obstacles for the same purpose, but without simulating a human opponent. Examples of these are described in the documents U.S. Pat. No. 4,538,808A, US 2004/157 685A, US 2006/105 863A, US 2007/010 354A and US 2010/160 093A.

There are generally disadvantages to the known solutions. For example, the first group of aids only concerns throwing from a standing position and is also in principle of use only to beginners. The solutions of the second group are also of only limited help. On the one hand, they do not represent a real obstacle, since the player does not require great skill to get round them, even when they contain parts that are moved. For the player, it is relatively easy to predict the movements of the obstacle and thus adapt his course accordingly and without any great effort.

Moreover, the known solutions of the second group are in principle only helpful for certain performance levels. They are either conceived specially for beginners and are therefore of only limited suitability for experienced players, if at all, or they are designed for experienced players and then cannot be used for beginners.

A further disadvantage of many solutions is that they are suitable only to a limited extent for players of different heights, which therefore means not only that a greater number of apparatuses are needed for different age groups but also for different levels of ability or development within an age group.

A disadvantage of many of the known solutions of the second group has also proven to be that the risk of injury is not inconsiderable, especially if the player crashes into the obstacle, when running round it or jumping, gets caught in the framework of the obstacle or lands on the obstacle with his feet after jumping.

A further disadvantage of many known solutions is that they partially impede the player in the free throw of the ball, but without this leading to any discernible learning effect.

It has also been found that many of these solutions do not bring about the desired progress in play itself since, despite being apparently "realistic", they do not reflect what really happens during play.

OBJECT OF THE INVENTION

It is accordingly an object of the present invention to provide a solution that allows effective training of a basketball player, both for throwing from a standing position and also when running and jumping during play. In addition, the solution should be able to be applied in a versatile way for different age groups or different heights and ability levels.

GENERAL DESCRIPTION OF THE INVENTION

According to the invention, this object is achieved by a device for ball-throwing training, which comprises

- a stand base,
- a supporting structure having at least two vertical guide posts able to be longitudinally adjusted relative to each other, and a spacer element, one end of one of the guide posts being arranged at the stand base and a distal end of another guide post being arranged at the spacer element,
- a covering surface which is fixed to the spacer element so as to at least partially obscure the view of a court, particularly of a throwing target, and which comprises an extendible screen and a stretch frame able to be adjusted between the rigid upper end and the extendible lower end of the screen, wherein the spacer element is arranged, on the side of the guide post that lies opposite the stand base, in such a manner that the covering surface in a first position, called the normal position, is arranged at right angles to the spacer element and, in this normal position, the ground projection areas of covering surface and stand base do not overlap, i.e. in the normal position no part of the covering surface is located vertically above the stand base. In a simple design of the device, the latter has only one (first) position or orientation of the covering surface in relation to the rest of the device. In this so-called normal position, the covering surface is accordingly oriented, in a plane parallel to the ground, at right angles (normal) to the spacer element and at right angles (normal) to the ground.

The proposed solution is based on the recognition that, in contrast to the apparent assumption of the known solutions, the presence of an obstacle does not represent the difficulty during the game but is "merely" the reason for the actual problem.

The actual problem during a game is that the player in practice has hardly any time to sight the target (e.g. the basket), since he has to concentrate, among other things, on the opposing players, on the possibly better positioned players of his own team and, of course, on the ball. If the player were able to sight the target for longer before taking the throw, there would be a greater prospect of hitting the target. The time actually required to obtain a sufficient target accuracy is dependent on the ability level or experience of the player; the more experienced a player is, the less time he needs to locate the target and to take his throw aimed at hitting this target.

The apparatus proposed here, or the device described here, makes it possible to do precisely this and to limit the target time even during training, at least to the extent that is also demanded during play by various factors such as the presence, position and stance of an opponent or of a team mate, the position of the player on the court, trajectory of the ball, etc. Depending on the embodiment, it is even possible to establish conditions that far exceed the degree of difficulty of normal play.

In order to achieve the described effect, the apparatus is placed at a suitable location on the court at a certain distance, e.g. between 0.5 and 12 m, preferably 1 to 9 m, in front of the basket and is adjusted according to the size and level of experience of the player. However, in each individual case, this distance can also be longer or shorter, depending on the purpose of the training and on the level of experience of the player.

The placement and set-up of the apparatus is very flexible, wherein the training objective is to improve the target accuracy when throwing from a standing position, when running and when jumping, and is achieved by the fact that the obstruction of the player's view of the basket during a pattern of movement on the one hand forces the player to hit the target even with a brief view thereof and on the other hand forces the player to try to lengthen this time by jumping higher. To put it more simply, the effective covering surface is in principle increased according to the degree of difficulty and, consequently, the time to detect the target is reduced.

The spacer element serves to keep the covering surface at a distance from both the stand base and also from the guide posts, in order to reduce as far as possible the risk of injury to the player. Generally, the length of the spacer element is between 0.5 and 1.2 m, preferably between 0.6 and 1.0 m. The spacer element can be straight or also bent. If so desired, the spacer element can also consist of a plurality of mutually adjustable parts, similar to the guide posts.

In a simple embodiment, as has already been mentioned, the covering surface is fixed at right angles to the spacer element in a plane parallel to the ground (first position, i.e. so-called normal position). However, the device preferably has a first joint element between spacer element and covering surface, for lateral pivoting of the covering surface relative to a first position (i.e. relative to the normal position) at right angles to the spacer element and thus permits further settings, so-called rotation settings of the covering surface. Such a joint element makes it possible on the one hand to vary the subjective width of the covering surface, i.e. the width as perceived from the position of the player, and on the other hand, while the spatial position of the covering surface remains constant, to laterally offset the stand base of the device if necessary or if so desired. A lateral offset of the stand base is important if jumps are to be made while running towards the device, so as to reduce the risk of injury when landing on the ground far behind the covering surface. The first joint element is preferably designed in such a way that it permits a lateral rotation of the covering surface by at least 45°, more preferably by up to 90°, towards the right and/or left relative to the normal position.

In the normal position, the extendible screen is arranged perpendicularly (normal) relative to the ground. In a further embodiment, the device has, in addition to or as an alternative to the first joint element, a second joint element between spacer element and stretch frame. This second joint element allows the extendible lower end of the screen to be pivoted towards the rear and/or towards the front, e.g. by at least 10°, preferably by up to 40°, with respect to the vertical, to further positions, so-called pivoted positions. Such a design allows ball-throwing to be practiced by means of jumps that are forced towards the rear and/or towards the front, as are required in practice, e.g. in front of a defending player. In addition, these forward or rearward settings encourage lifting and/or guiding the ball close to the body, depending on the setting, as is necessary in international basketball in order to effectively prevent the intervention of a defender.

In such a case, the screen of the covering surface is held in this position, or pivoted position, by the second joint element and by the stretch frame. In order to further reduce the risk of injury, the stretch frame is preferably made of light material, which itself is flexurally elastic and/or is arranged resiliently on the device.

The stand base offset rearwards with respect to the covering surface can have one or more rollers, e.g. two or three rollers, in order to make it easier to move the device about the court. At least some of these rollers are preferably able to be fixed.

In a simple form, the stand base is designed such that it also serves as a counterweight to the offset covering surface, in order to prevent the device from tipping over, preferably also when a player hangs onto the covering surface. In a further embodiment that is easier to transport, or in order to further stabilize other embodiments, the stand base is also subject to a detachable counterweight, preferably a detachable and fillable hollow counterweight. Such a hollow counterweight can be easily transported when empty and can then be filled on site, for example with sand or water.

In order to further standardize the training, the device preferably has boundary rods protruding above the covering surface (and screen) and preferably arranged above the screen, on both sides of the covering surface. These boundary rods serve, on the one hand, to encourage the player to throw the ball as centrally as possible over the covering surface and, on the other hand, they allow the trainer to safely ascertain whether the player has in fact thrown the ball over the covering surface. In a further embodiment, these boundary rods can also be arranged to be laterally displaceable, for example in order to further increase the difficulty by reducing the space between the rods.

Suitable materials for supporting structure and stand base are metal, e.g. steel or aluminium, (optionally (fibre) reinforced) plastics or polymers, and also wood. However, apart from the counterweight, which in principle is mostly heavy, the component parts of the device should as far as possible be made of light but stable materials. In a preferred embodiment, at least the vertical guide posts, the spacer element and the stand base are composed at least partially of a hard and light material, preferably of carbon-fibre-reinforced polymer.

The at least two vertical guide posts permit the stepless or step-by-step adjustment of the length of the entire post, i.e. the height of the upper edge of the covering surface above the ground. "Vertical" within the meaning of the invention signifies that the guide posts extend upwards at an angle to the ground of ca. 90°+/−20°. For this purpose, these guide posts are longitudinally adjustable relative to each other, either one inside the other in the form of a telescopic guide or preferably alongside each other in the form of a slide and/or rail guide. For simple adjustment of the length, the device preferably has a catch or a grip, which latches in the desired position, e.g. by means of a locking mechanism.

The device is preferably provided such that the at least two vertical guide posts are longitudinally adjustable relative to each other in such a way that the upper edge of the covering surface can be adjusted at a height H1 of between 1.5 and 3.0 m above the ground.

The maximum extendible length of the screen is usually between 0.3 and 2.0 m, preferably up to 1.5 m, e.g. between 400 and 1300 mm. The width of the screen usually measures between 0.8 and 2.5 m, preferably 1.2 to 2.0 m, e.g. 1.6 m. The screen is preferably made from a flexible and light material, e.g. a film, a woven fabric or a nonwoven fabric, plastic, synthetic or natural fibres, or a mixture or composite of several of these materials.

In one embodiment, the screen can be rolled up about a shaft. Other possibilities of obtaining an extendible screen are by prefolding (similar to folding blinds) or by slats (similar to venetian blinds). The screen can be of one colour or can also have differently printed surfaces. For example, horizontal lines or colour gradations allow the player to better assess his jump height. The screen can also have various motifs (e.g. very sharply contrasted areas) that are intended to irritate the player and thus further intensify the effect of the training.

To protect the screen during transport or when stowing it away after the training, the covering surface also preferably has a receptacle in which the screen is arranged in the retracted or rolled-up state.

In a further embodiment, the settings can be assisted partially or completely by motor or can even be automated, e.g. by electrical actuators that can adjust the height H1 of the upper edge of the covering surface and/or the height of the screen, or the height H2, according to various criteria (e.g. height and experience of the player, type of throw, etc.). This automation can be provided by means of electronic control, such that a series of relevant parameters of players can be programmed in, and these parameters can then be called up, e.g. at the press of a button or by authentication (RFID, fingerprint, etc.).

A further aspect of the invention relates to the use of a device as described herein for throw training, in particular for improving target accuracy in basketball. It should be noted that the device proposed here can also be used for other types of sports in which target accuracy under time pressure is important.

A further aspect of the invention relates to a method for improving the target accuracy of a player when throwing a ball, in particular when playing basketball, which method comprises the following steps:

- placing a device as described herein on a basketball court at a distance d in front of the basket,
- setting the height H1 of the upper edge of the covering surface by adjusting the guide posts relative to each other,
- setting the height H2 of the lower edge of the covering surface by extending or unrolling the screen and adjusting the adjustable stretch frame, wherein the distance d in front of the basket, the height H1 of the upper edge and the height H2 of the lower edge of the covering surface 2 are chosen such that the covering surface at least partially obscures the view of the basket for the player located in front of or approaching the device and only reveals this view for a brief period t1 during the jump made by the player in front of the device.

The method proposed here makes it possible to limit the target time, even during training, at least to such an extent as is also demanded by various factors such as the presence, position and stance of an opponent or of a teammate, the position of the player on the court, trajectory of the ball, etc. In addition, it is even possible to establish conditions that far exceed the degree of difficulty of normal play.

A further advantage of the method is that, by varying the settings, it is possible to influence not only the period t1 of the unobstructed view, but in addition also the period t2 during which the target is concealed. The period t1 (target visible) allows the player to sight the target in order to hit it. He himself can influence this period t1 (to a limited degree) by jumping higher. Through repetition, the player will therefore not only improve his target accuracy with a brief view of the target, but also his jumping force. By contrast, the period t2 (target concealed) forces the player to take note of the position of the target or anticipate it in relation to his own position. The better he is able to do this, i.e. the greater the overlap between the actual and the anticipated target, the better his feel for throwing and shooting, and the shorter also the period t1. This means as follows: of two ball throwers defended with the same intensity in one and the same game situation, the one that trains using this method has a higher scoring ratio, because he is better able to cope, as a result of his training, with the brief period t1 available to him.

The abovementioned period t1 depends on the level of experience of the player and on the distance to the target and is usually between 0.1 second for experienced players and 2.5 seconds for beginners. Depending on the level of experience of the player and on the distance to the target, the abovementioned period t2 is usually at least 1 second, preferably at least 2 seconds.

However, the most important advantage of this training method (and of the device according to the invention) is that it is equally suitable for players of all age groups, of all heights and of all ability levels, simply through the easy and quick set-up and adjustment of the device. All important variants of play, such as throwing from a standing position, when running and when jumping, can also be performed near the device even under conditions that are made difficult. Neither the setting-up and adjustment of the device nor the training itself requires a second person: solo training is readily possible.

BRIEF DESCRIPTION OF THE FIGURES

Further details and advantages of the invention may be taken from the following detailed description of possible embodiments of the invention with reference to the attached figures, in which.

Further details and advantages of the invention may be taken from the following detailed description of possible embodiments of the invention with reference to the attached figures.

DESCRIPTION OF ONE OR MORE EMBODIMENTS OF THE INVENTION

The device shown in the figures in order to illustrate the invention consists in principle of three important main parts:

1. The Covering Surface

Figure 4:
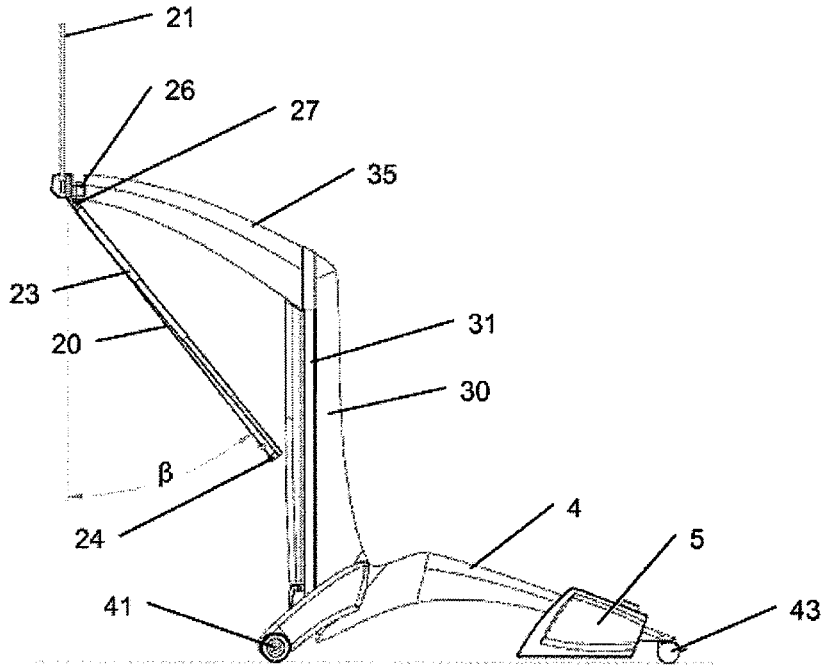
FIG. 4 shows a side view as in FIG. 3, but with the screen adjusted towards the rear.
Figure 5:
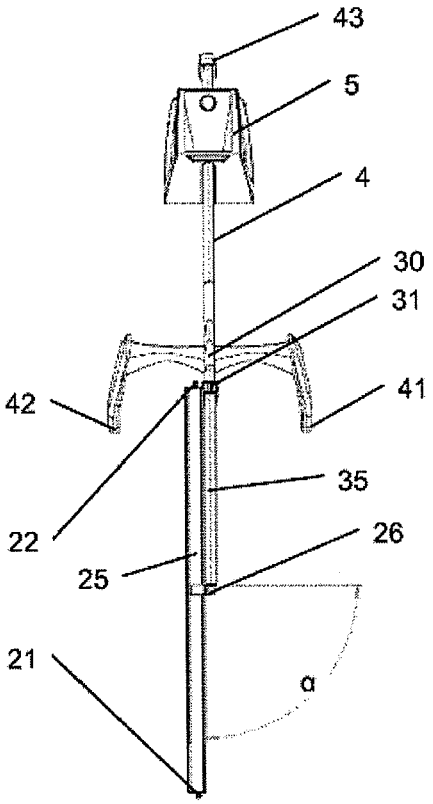
FIG. 5 shows a plan view of an embodiment as in FIG. 1, but with the covering surface laterally adjusted.

The covering surface 2 is preferably a roll-up screen 20 (with two boundary rods 21, 22 provided to the right and left), wherein the size of the surface can be adjusted vertically in a stepless manner by extension (e.g. between 400 and 1200 mm) with the aid of a telescope 23 (stretch frame, see FIG. 2), which is fixed to the supporting structure 3. The lower part of the covering surface 2 can be adjusted forwards or rearwards (altered pivot position, see FIG. 4). The complete covering surface 2 can preferably be rotated laterally (horizontally) to the right or left by up to 90° ($-90° \leq \alpha \leq +90°$ and can be secured in this position (altered rotation position, see FIG. 5).

2. The Supporting Structure

Figure 1:
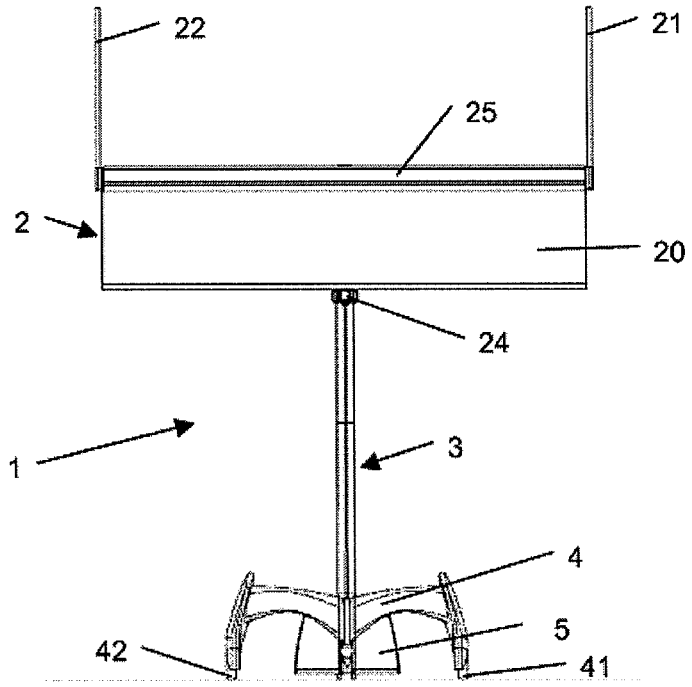
FIG. 1 shows a front view of an embodiment of the device according to the invention.
Figure 2:
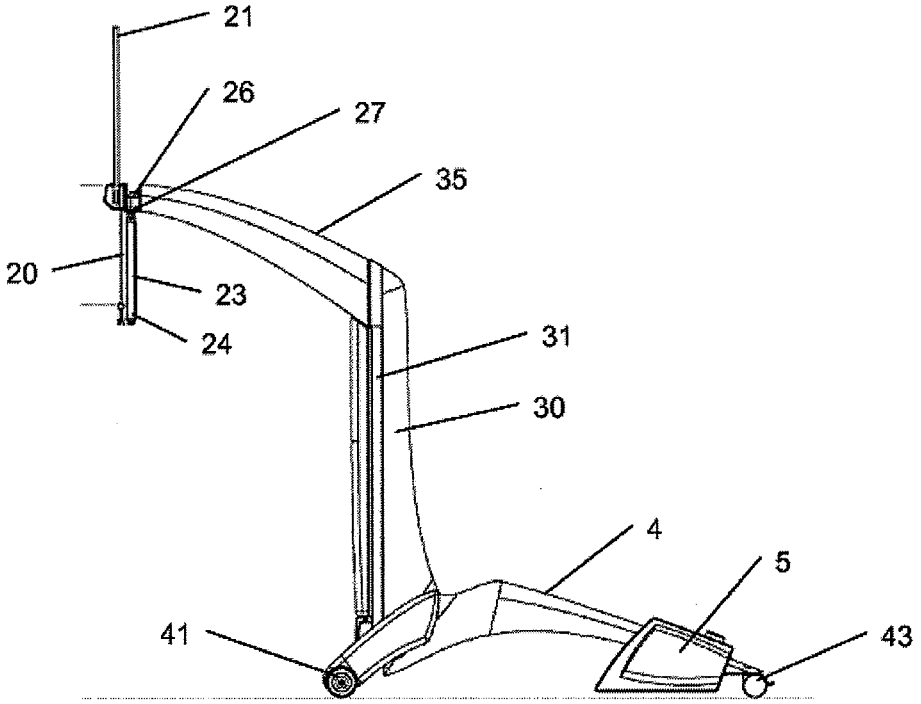
FIG. 2 shows a side view of the embodiment of FIG. 1.
Figure 3:
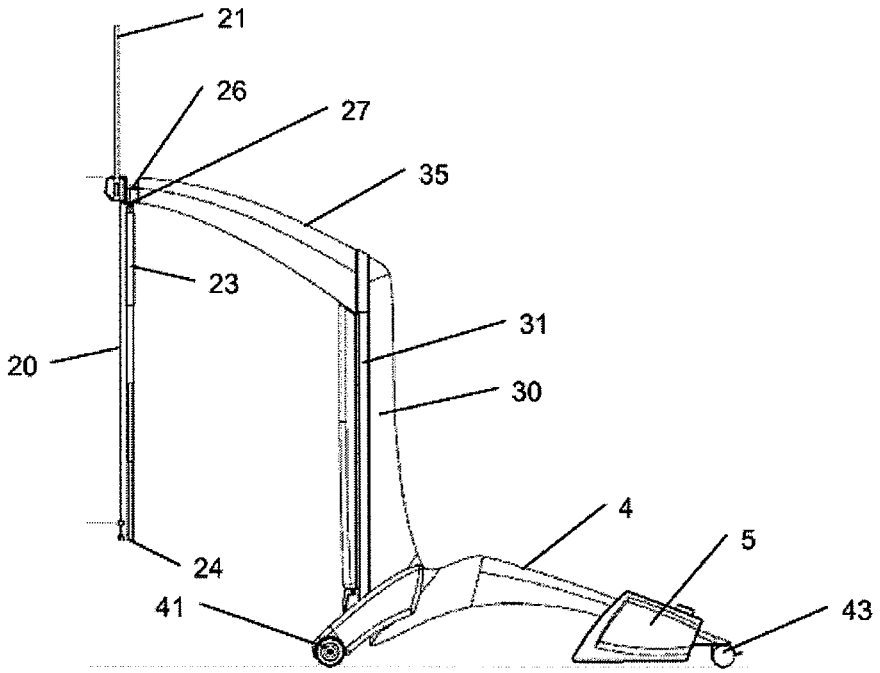
FIG. 3 shows a side view as in FIG. 2, but with the screen in an extended setting.
Figure 6:
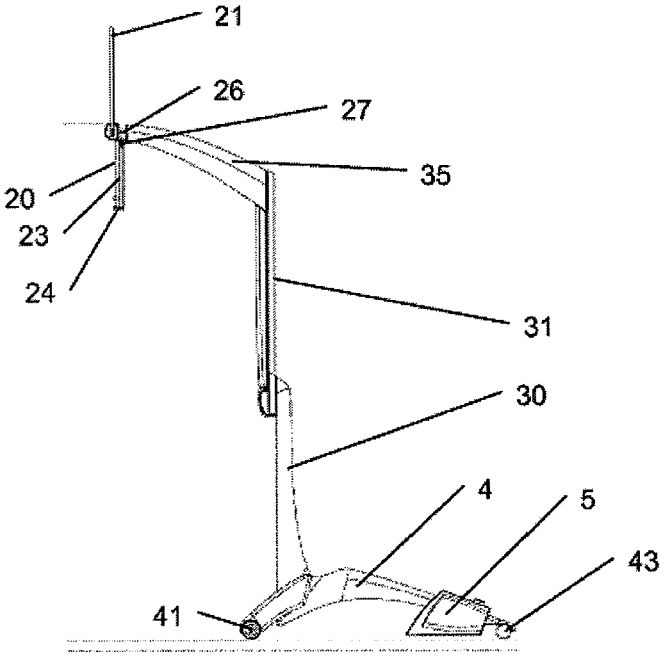
FIG. 6 shows a side view as in FIG. 2, but with the covering surface in a raised setting.

The supporting structure 3 holds the covering surface 2, which is fixed to the spacer element 35 of the supporting structure (see FIG. 2). With the aid of the movable upper part 31, mounted on the centre pillar 30, and of the handle 32, the maximum height H1 of the covering surface 2 can be set anywhere between, for example, 1700 and 2800 mm (compare FIGS. 2 and 6). The supporting structure 3 is preferably produced from (hard and light) carbon-fibre-reinforced polymer. The supporting structure 3 rests on (three) rollers 41, 42, 43, whereby the apparatus 1 can be moved easily and freely about the court (see FIGS. 1-2).

3. The Counterweight

The counterweight 5 is preferably produced from plastic, can be filled with water or sand and is placed on the prepared stand base 4 (see FIG. 1 for example). The counterweight 5 is responsible for the secure standing position of the apparatus 1 and should weigh at least 20 kg when filled.

4. The Use of the Apparatus

The apparatus 1 is used in basketball throwing training for all age groups (from 14 years), irrespective of the physical and technical ability of the players and entirely independently of the physical make-up of the individual players (height of 160 cm to 225 cm).

The basketball players take the throws in front of the throw training instrument, and they have to perform the throws such that the ball always flies between the antennas in the direction of the basket. The players will probably take the throws from a standing position, but they may also make various movements before the throw (dribbling, getting free, cutting, etc.) and then perform the throws after stopping in front of the apparatus.

The settings of the apparatus have to be adapted to the physical, technical and tactical training level or the physical circumstances of the players and the ranges of the throws (near throws, distance throws, three-point throws).

The instrument reduces the target time of the thrower, and the degree of difficulty of the apparatus can be modified in any way that the trainer sees fit. It is a scientific fact that the longer one has to take aim, the better the scoring accuracy. If the thrower trains with a shorter target time, he can also shoot more accurately in play with a longer target time (even the best defender cannot better reduce the target time of the thrower and at the same time cannot better prevent the throw).

If the player jumps higher when taking his throw, he has a longer time to take aim and can therefore also take a better shot. That is to say, this apparatus forces the players to execute all throws with a maximum jump, as a result of which it is possible to greatly develop the jumping force and the safe posture in the air.

Since the rollers (as seen by the player) are located at least ca. 60 cm behind the covering surface, there is no risk of injury when landing after the jump, not even when the player has come down in the direction of the apparatus.

With the adjustment of the lower part of the covering surface towards the front or rear ($-40° \leq \beta \leq +40°$, the vertical direction of the jump and the position of the ball lift can be radically influenced. The covering surface is 160 cm wide for example, and, after the throw, it therefore functions like the blocking defender (for the thrower to get round), but, since the surface can also be turned sideways, there is also no risk of injury here.

Explanation of reference signs:

| | Name | Alternative name |
|---|---|---|
| 1 | device | apparatus |
| 2 | covering surface | |
| 20 | screen | |
| 21, 22 | boundary rods | |
| 23 | stretch frame | telescope |
| 24 | mounting | |
| 25 | receptacle | |
| 26 | first joint element | |
| α | angle setting of the first joint element | |
| 27 | second joint element | |
| β | angle setting of the second joint element | |
| 3 | supporting structure | load-bearing support structure |
| 30 | guide post | lower guide post |
| 31 | guide post | upper guide post |
| 32 | handle | |
| 35 | spacer element | |
| 4 | stand base | |
| 41, 42, 43 | rollers | |
| 5 | counterweight | |

The invention claimed is:

1. A device (1) for ball-throwing training, which comprises a stand base (4), a supporting structure (3) having at least two vertical guide posts (30, 31) longitudinally adjustable relative to each other, and a spacer element (35), one end of one of the guide posts (30) arranged at the stand base (4) and a distal end of another guide post (31) arranged at the spacer element (35), a covering surface (2) fixed to the spacer element (35) so as to at least partially obscure the view of a throwing target, and which comprises an extendable screen (20) and a stretch frame (23) adjustable between the rigid upper end and the extendable lower end of the screen (20), the spacer element (35) positioned on an end of the guide post (31) that lies opposite the stand base, in such a manner to support the covering surface (2) in a first position, called the normal position, at right angles to the spacer element (35) and, so that in this normal position, the ground projection areas of covering surface (2) has a position horizontally separated from the stand base (4) so that the ground projection areas of covering surface (2) and the stand base (4) do not overlap, and a second joint element (27) provided between spacer element (35) and stretch frame (23), the second joint element (27) permitting pivoting of the extendable end of the screen towards the rear and/or towards the front by up to 40° (β) towards the rear and/or front.

2. The device according to claim 1, wherein a first joint element (26) is provided between spacer element (35) and covering surface (2) in order to permit lateral pivoting of the covering surface (2), preferably by up to 90°, to the right and/or left relative to the normal position.

3. The device according to claim 1, wherein the stretch frame (23) is flexurally elastic and/or is arranged resiliently on the device (1).

4. The device according to claim 1, wherein the stand base (4) has one or more rollers (41, 42, 43).

5. The device according to claim 1, wherein the stand base (4) has a detachable, fillable counterweight (5).

6. The device according to claim 1, wherein boundary rods (21, 22) protruding above the covering surface are arranged above the screen (20), on both sides of the covering surface (2).

7. The device according to claim 1, wherein the vertical guide posts (30, 31), the spacer element (35) and the stand base (4) are composed at least partially of carbon-fibre-reinforced polymer.

8. The device according to claim 1, wherein the at least two vertical guide posts (30, 31) are longitudinally adjustable relative to each other, either one inside the other in the form of a telescopic guide or alongside each other in the form of a slide and/or rail guide.

9. The device according to claim 1, wherein the at least two vertical guide posts (30, 31) are longitudinally adjustable relative to each other in such a way that the upper edge of the covering surface can be adjusted between 1.5 and 3.0 m above the ground.

10. The device according to claim 1, wherein the maximum extendable length of the screen (20) is between 0.3 and 1.5 m.

11. The device according to claim 1, wherein the covering surface moreover comprises a receptacle (25) in which the screen is arranged in the retracted state.

12. A method for improving the target accuracy of a basketball player using the device for ball-throwing training, the method comprising the following steps:

providing a stand base (4);

providing a supporting structure (3) having at least two vertical guide posts (30, 31) longitudinally adjustable relative to each other, and a spacer element (35), with one end of one of the guide posts (30) arranged at the stand base (4) and a distal end of another guide post (31) arranged at the spacer element (35);

providing a covering surface (2) fixed to the spacer element (35) so as to at least partially obscure the view of a throwing target, and which comprises an extendable screen (20) and a stretch frame (23) adjustable between the rigid upper end and the extendable lower end of the screen (20);

positioning the spacer element (35) on an end of the guide post (31) that lies opposite the stand base, in such a manner to support the covering surface (2) in a first position, called the normal position, at right angles to the spacer element (35) and, so that in this normal position, the ground projection areas of covering surface (2) has a position horizontally separated from the stand base (4) so that the ground projection areas of covering surface (2) and the stand base (4) do not overlap, and providing a second joint element (27) between spacer element (35) and stretch frame (23), the second joint element (27) permitting pivoting of the extendable end of the screen towards the rear and/or towards the front by up to 40° (β) towards the rear and/or front;

placing the device on a basketball court at a distance d in front of the basket;

placing the device having two boundary rods between a basketball goal and the basketball player;

setting the height H1 of the upper edge of the covering surface (2) by adjusting the guide posts (30, 31) relative to each other;

setting the height H2 of the lower edge of the covering surface (2) by extending the screen (20) and adjusting the adjustable stretch frame (23);

adjusting settings of the device according to physical, technical, and tactical training levels associated with the basketball player;

adjusting the settings for the physical circumstances of the player and ranges of throws the basketball player performs; and pivoting of the extendable end of the screen by up to 40° towards the rear or the front, wherein the distance d in front of the basket, the height H1 of the upper edge and the height H2 of the lower edge of the covering surface (2) are chosen such that the covering surface at least partially obscures the view of the basket for the player located in front of the device and only reveals this view for a brief period t1 during the jump made by the player in front of the device, and wherein the ranges of throws includes the basketball player performing near throws, distance throws, and three-point throws.

13. The method according to claim 12, wherein the period t1 depends on the level of experience of the player and is between 0.1 second for experienced players and 2.5 seconds for beginners.

* * * * *